US005503551A

United States Patent [19]

Houston

[11] Patent Number: 5,503,551

[45] Date of Patent: Apr. 2, 1996

[54] ROTARY VALVE FOR FUME INCINERATOR

[76] Inventor: Reagan Houston, 252 Foxhunt La., Hendersonville, N.C. 28739

[21] Appl. No.: 463,933

[22] Filed: Jun. 5, 1995

[51] Int. Cl.[6] ..... F27D 17/00

[52] U.S. Cl. ..... 432/181; 432/178; 432/179; 432/180; 110/212

[58] Field of Search ..... 432/178, 179, 432/180, 181, 163, 164, 165, 166; 110/212

[56] References Cited

U.S. PATENT DOCUMENTS

| | | | |
|---|---|---|---|
| 3,045,692 | 7/1962 | Reynolds et al. | 137/240 |
| 3,211,534 | 10/1965 | Ridgway | 23/277 |
| 3,634,026 | 1/1972 | Kuechler et al. | 23/2 C |
| 3,870,474 | 3/1975 | Houston | 23/277 C |
| 4,126,419 | 11/1978 | Katabuchi et al. | 422/109 |
| 4,280,416 | 7/1981 | Edgerton | 110/254 |
| 5,016,547 | 5/1991 | Thomason | 110/211 |
| 5,026,277 | 6/1991 | York | 432/181 |
| 5,375,622 | 12/1994 | Houston | 137/240 |

OTHER PUBLICATIONS

US Document Disclosure Number 375,595 dated May 2, 1995 for a 5-bed Valve.

*Primary Examiner*—Henry A. Bennet

*Assistant Examiner*—Siddharth Ohri

*Attorney, Agent, or Firm*—Charles L. Schwab

[57] ABSTRACT

A single rotary valve is designed to control feed, purge and exit flow in a multiple bed regenerative fume incinerator system thereby replacing the large number of valves heretofore used to operate such a system. The housing of the rotary valve has ports or connection to at least one feed conduit, to at least one exit conduit, to at least 3 regenerator bed conduits and includes an annular opening on the valve axis for a purge gas conduit. The purge gas conduit extends through the annular opening and connects to an interior cavity of the valve rotor which has a peripheral opening registrable individually with the regenerator bed ports. The valve rotor divides the interior chamber of the valve housing into a feed subchamber and an exit subchamber and includes a sealing plenum preventing leakage from the feed subchamber to the exit subchamber. In each of the flow control positions to which the valve rotor is rotatable, one regenerator bed port is connected to the peripheral opening in the valve rotor, half of the remaining regenerator bed ports are connected to the feed subchamber and the other half of the remaining regenerator ports are connected to the exit subchamber. In one embodiment, the valve rotor is tapered and may be adjusted axially to compensate for wear, to prevent rubbing or to increase clearance for some operating conditions.

22 Claims, 5 Drawing Sheets

ROTARY VALVE FOR FUME INCINERATOR

RELATED PATENT APPLICATIONS

A related rotary valve is shown and claimed in my copending U.S. patent application Ser. No. 08/441,394 filed May 15, 1995 for Three Bed Rotary Valve and Fume Incineration System.

TECHNICAL FIELD

This invention relates to a valve for controlling the flow of feed, purge and cleaned gases in a fume incinerator system having three or more regenerator beds.

BACKGROUND OF THE INVENTION

Regenerative tiptoe incinerators, also called regenerative thermal oxidizers, receive air or gas containing volatile organic compounds, VOC's. The gas is heated in a regenerator bed packed with ceramic pieces. At the hot end of the bed, fuel and air are added thru a burner to heat the gas up to the range of 1400 to 1800 deg. F. At this temperature, the VOC's are oxidized to CO2 and H2O by the oxygen present. The hot purified gas then enters one of the other regenerators where the gas is cooled and discharged from the system. At intervals the gas flow is reversed so that each bed is alternately cooled and heated. To improve the gas purification, a third bed is used so that the feed bed can be purged with clean gas before being used as an exit bed.

The three bed arrangement, which is the standard in the industry, is shown, for instance, in FIG. 1 of the attached drawings and in Houston U.S. Pat. No. 5,026,277. Unfortunately, six large powered valves, plus 3 smaller powered valves for the purge, are required in these prior art systems. For large regenerators, it is common to use live, or even 7, beds. When using five beds, two beds receive feed gases, two beds are used for exit gases and one bed receives purge gases. With such a system, 15 powered valves are required. Since the feed and exhaust ducts are often 4 feet or more in diameter, the valves are very expensive. Operation of the many valves requires an extensive computer system to open and close the valves at the correct moment and to indicate the actual valve position. Continued good maintenance is required since a leaky main valve will allow impure feed gas to flow directly into the purified exit gas. Large rotary valves heretofore used for controlling hot incinerator gases have leakage problems caused by thermal expansion of the valve components. The edges of the rotor cannot seal tightly against the inside of the valve body while allowing the rotor to move easily. The impure feed gas is at a higher pressure than the exit gas so leakage along the outside of the rotor allows impurities to get into the exit gas.

OBJECTS AND SUMMARY OF THE INVENTION

It is an object of this invention to provide a rotary valve for controlling flow in a fume incinerator apparatus which greatly reduces the number of valves, simplifies the controls required, reduces maintenance, reduces initial cost and repair of the system and prevents contamination of the cleaned exiting gases.

The rotary valve of this invention is simply in construction and requires less space than previously needed for the multitude of valves which it replaces. By routing the purge gases through a central pan of the valve rotor and providing a plenum around the peripheral edge of the rotor to which the purge gases are feed, leakage of feed gases across the valve rotor edge to the exiting clean gases is prevented. The rotary valve of this invention can be used in a three bed Fume incinerator and it is especially appropriate for regenerative incinerator systems having five or more regenerator beds. In a fume incinerator system using seven regenerator beds, this single valve replaces twenty-one powered valves all of which must be properly sequenced by an expensive control system.

BRIEF DESCRIPTION OF THE DRAWINGS

Several embodiments of the invention are shown in the attached drawings, in which.

DETAILED DESCRIPTION OF THE DRAWINGS

Figure 1:
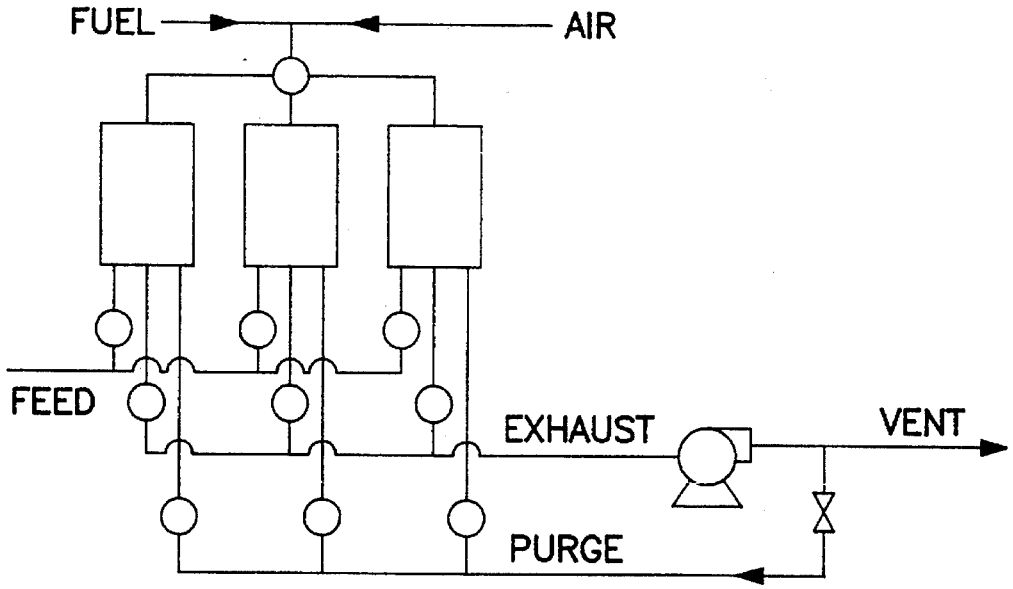
FIG. 1 illustrates a three regenerator bed fume incinerator of the prior art.

FIG. 1 shows a typical three regenerator bed flame incinerator system in which impure feed gases are sequentially routed to the three regenerator beds by three powered valves. The regenerator beds, which contain heat exchange material such as ceramic pieces, are connected to the exhaust blower one at a time by the three more powered valves. Purge gas in the form of cleaned gas pressurized by the exhaust blower is delivered to the regenerator beds, one at a time, by three additional powered valves.

Figure 2:
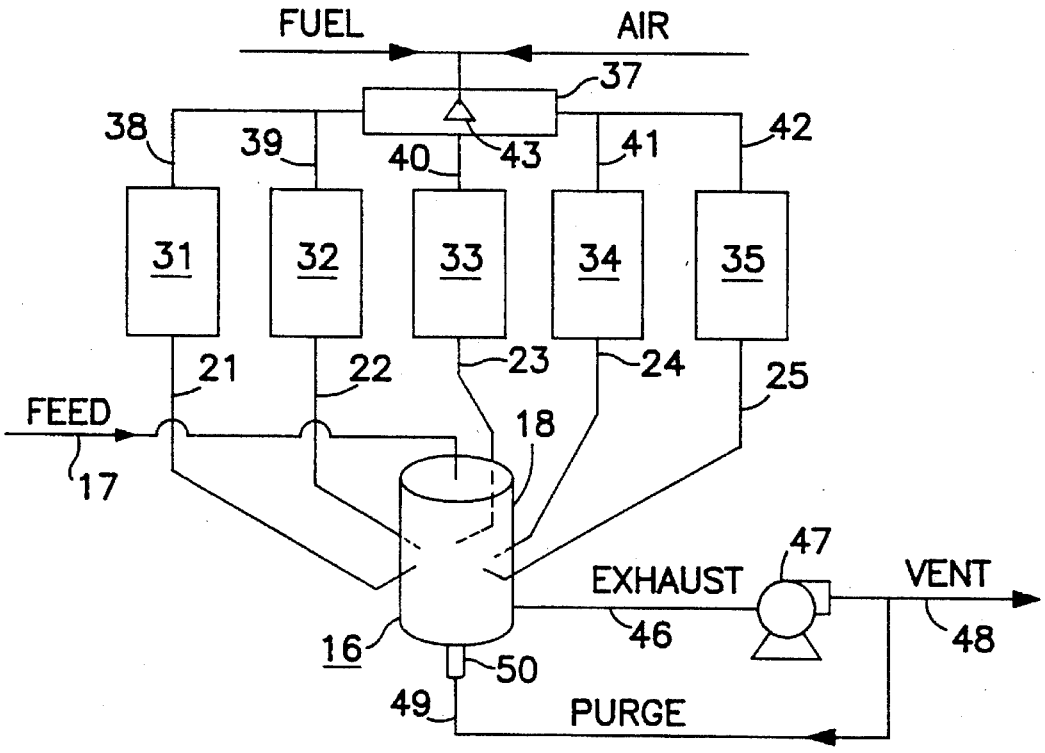
FIG. 2 illustrates a five regenerator bed fume incinerator system using the rotary valve of the present invention.

As shown in FIG. 2, the rotary valve 16 of this invention is generally cylindrical in shape with a feed conduit 17 connected to the upper section of the valve housing 18. Five regenerator bed conduits 21, 22, 23, 24 and 25 are connected to middle section of the valve housing 18 at equally spaced intervals about circumference of the housing. The conduits 21–25 connect to the bottoms of the regenerator beds 31, 32, 33, 3,1, and 35. The tops of the regenerator beds are connected to a furnace chamber or plenum 37 by conduits 38, 39, 40, 41, and 42, the furnace plenum being heated by a burner 43 to which fuel and air are supplied. The furnace plenum is typically kept at 1400 to 1800 deg. F. A clean gas or exhaust conduit 46 interconnects the lower section of the valve housing 18 to an exhaust blower 47 which delivers the cleaned gases to the atmosphere through exit conduit 48. Purge gas, pressurized by the exhaust blower 47 to a higher pressure than the feed gas, is delivered by a purge gas conduit 49 to a hollow valve rotor shaft in the form of a pipe 50 disposed in coaxial relation with the axis of the valve rotor.

Figure 3:
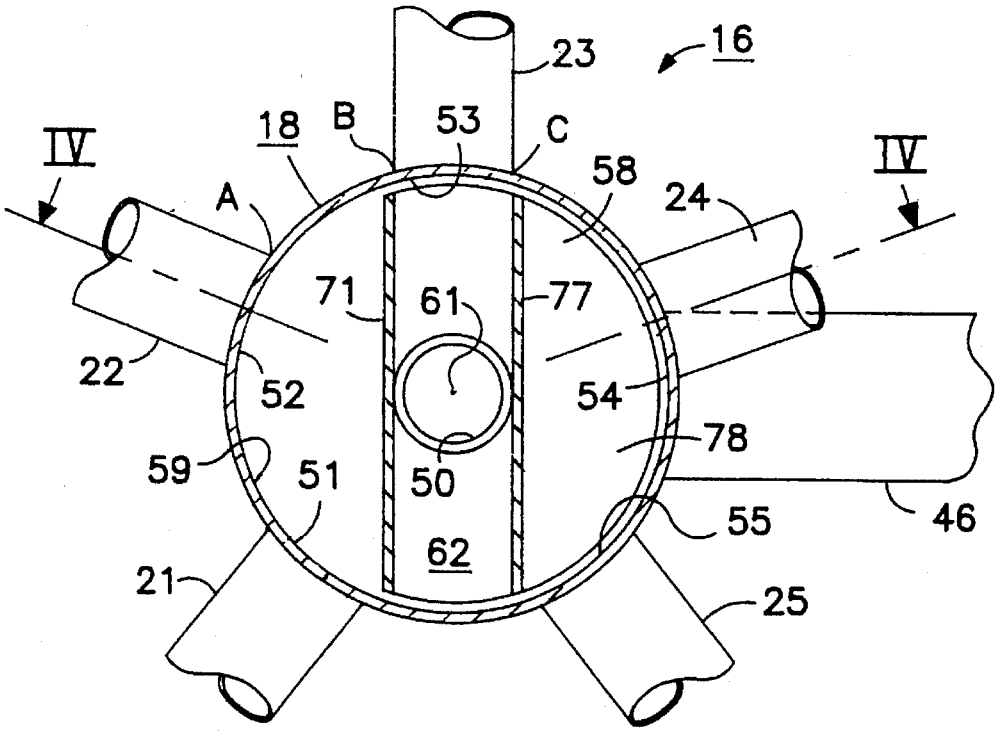
FIG. 3 is a section taken along the line III—III in FIG. 4.
Figure 4:
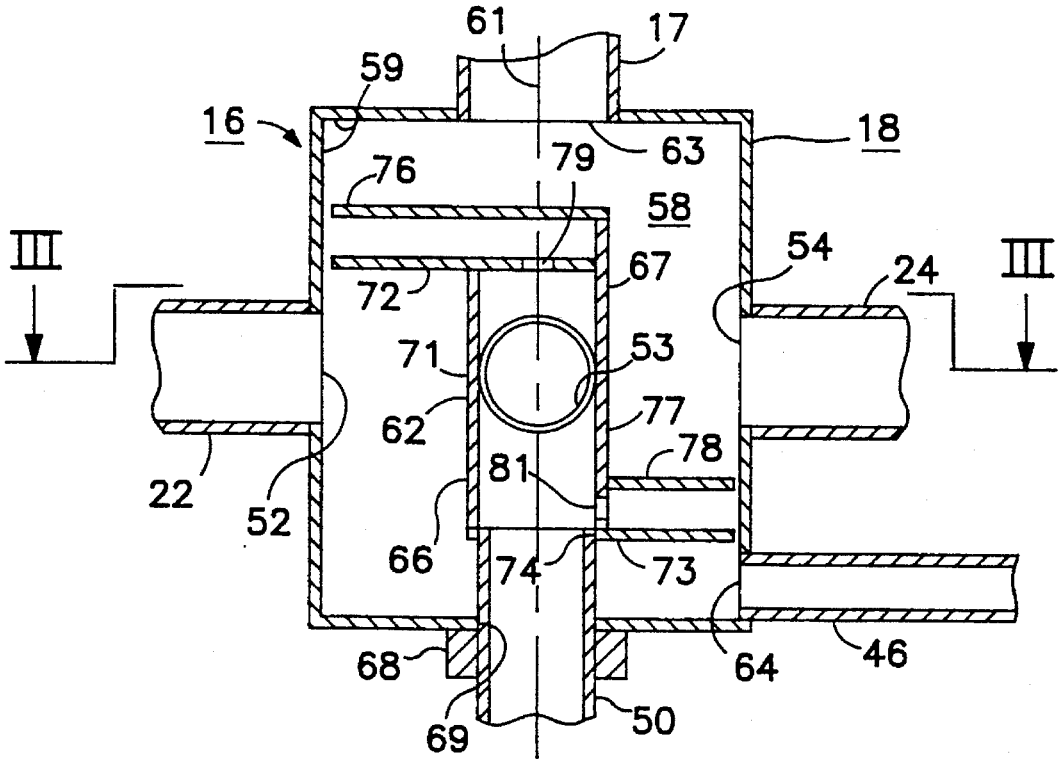
FIG. 4 is a section taken along the line IV—IV in FIG. 3.

FIGS. 3 and 4 are horizontal and vertical sections of the rotary valve of this invention illustrated in FIG. 2. FIG. 3 shows the live regenerator bed conduits 21–25 connected to the middle section of the valve housing 18 at equally spaced interval with the conduits 21–25 separated by at least one circumferential width of a regenerator bed conduit. More specifically, the distance from Point A to Point B is at least as great as the distance from Point B to Point C. Referring also to FIG. 4, the regenerator bed conduits 21–25 are connected to the valve housing 18 at regenerator bed conduit openings or ports 51–55 in the housing 18. The ports 51–55 are spaced circumferentially around the middle section of the valve housing and open into the middle zone of the interior chamber 58 of the housing 18, the interior chamber 58 being defined by an interior surface 59 generated by rotating a line about the axis 61 of a valve rotor 62 rotatably mounted in the housing 18 by the hollow shaft 50. As shown in FIG. 4, the feed conduit 17 is connected to a feed conduit opening or feed port 63 in the upper section of the housing 18 to deliver feed gas to the upper zone of the interior chamber 58 and the exit or clean gas conduit 46 is connected to an exit port 64 in the lower section of the housing 18 to permit exhaust of cleaned gas from the lower zone of the housing 18.

The rotor 62 includes a pair of walls 66, 67 extending alongside one another from one side of the lower zone of the chamber 58 to the diametrically opposite side of the upper zone of the chamber 58. At the middle zone of the chamber 58, the walls 66,67 are spaced apart a distance at least equal to the circumferential width of a regenerator bed conduit opening, that is, the distance from Point B to Point C. The walls 66,67 have sealing edges close to the interior surface 59 defining the interior chamber 58 of the valve housing 18 but do not touch the interior surface 59. The rotor walls 66,67 may also be described as extending from the interior surface 59 at the upper section of the valve housing 18 at one side of the rotor axis 61 to the interior surface 59 at the lower section of the valve housing 18 at the diametrically opposite side of the rotor axis 61

The rotor shaft 50 is a tube so as to serve as a purge conduit connector through its rotary connection with the purge conduit 49. The purge conduit connector or rotor shaft 50 is rotatably supported by a sleeve bearing and seal unit 68 at an annular opening 69 in the bottom of the housing 18.

The wall 66 of the rotor includes a vertical wall part 71, an upper horizontal wall part 72 and a lower horizontal wall part 73. The purge conduit connector 50 is secured, as by welding, to the horizontal wall part 73 where it registers with an annular opening 74 in the lower horizontal wall pan 73. The rotor wall 67 includes an upper horizontal wall part 76, a vertical wall part 77 and a lower horizontal wall pan 78. The upper horizontal wall part 76 extends to the right as viewed in FIGS. 3 and 4, to edges adjacent the interior surface 59 at one side of the rotor axis and the lower horizontal wall part 78 of rotor wall 67 extends from the lower end of the vertical wall part 77 to an edge adjacent to, or in close proximity to, the interior surface at the diametrically opposite side of the rotor axis 61. In a similar fashion the upper and lower horizontal wall parts of rotor wall 66 extend from the upper and lower ends of vertical wall part 71 to diametrically opposite portions of the interior surface 59 of the rotor housing 18. The horizontal wall parts are segments with outer edges shaped as an arc and a chord. The vertical wall parts 71, 77 of the rotor walls 66, 67 are located in the middle zone of the interior chamber 58 of the rotor housing 18 and are spaced in parallel relation to one another a distance at least as great as the diameter of the regenerator conduit openings in the housing 18. The upper horizontal wall part 72 of wall 66 has holes 79 to permit passage of purge gas to the space between parallel horizontal wall parts 72,76. The vertical wall part 77 has holes 81 permitting passage of purge gases to the space between parallel horizontal wall parts 73, 78. The walls 66,67 of the valve rotor 62 divide the interior chamber 58 of the valve housing 18 into an upper feed subchamber and a lower exit or exhaust subchamber, the feed subchamber being defined by the rotor wall 67 and the interior surface 59 of the housing 18 and the lower subchamber being defined by the rotor wall 66 and the interior surface 59 of the valve housing 18. The space between the parallel wall parts of the rotor walls 66, 67 form a sealing plenum preventing passage of contaminated feed gases from the feed subchamber to the clean gas or exit subchamber. The horizontal wall parts 72, 78 are positioned sufficient distances above and below the regenerator conduit openings to minimize leakage from the feed subchamber to the exit subchamber. The purge gas is clean exit gas pressurized by the exhaust blower 47 at a higher pressure than the feed gases. Thus some purge gas will pass to the feed gas subchamber where it will mix with the feed gases and again pass through the furnace chamber. This, of course, does not harm the purity of the exit gas. The walls 66, 67 of the hollow valve rotor 62 form a sealing plenum which extends 360 degrees around the rotor to effect a sealing relationship with the interior surface 59 of the substantially cylinder shaped interior chamber 58.

Instead of a purge flow of pure gas into the purge zone, the purge zone may be held at a pressure less than the exit gas pressure. In this case, purge gas is drawn out of the purge zone, out of the valve and pumped into the feed gas stream for subsequent purification. With proper out flow of purge gas, there is no contamination of the exit gas.

With the rotor in the position shown in FIG. 3, feed gas flows through conduits 24, 25 to regenerator beds 34, 35, purified exit gas flows from beds 31,32 by way of conduits 21,22 to the exit subchamber and are exhausted through exit opening and exit conduit 46 and purge gas is supplied to the regenerator bed 33 by way of purge conduit 49, connector 50, the interior purge zone of the rotor, port 53 and regenerator bed conduit 23. After the desired interval, such as 30 to 180 seconds, the bed 34 has been cooled as much as desired by the relatively cool incoming feed gas. Bed 31 has been heated as much as desired by the heat of the out going exit gas. The rotor is now rotated clockwise, as viewed in FIG. 3, so that the purge zone of the rotor is moved to the port 54 for regenerator bed 34. Feed gas now flows to the regenerator beds 31 and 35 with regenerator beds 32 and 33 being connected to the exit or exhaust conduit 46. At the end of each interval, the rotor is indexed to the next bed. Thus the heat retaining pieces of each regenerator bed are sequentially cooled by feed gas, purged and then warmed by exit gas. The result is an efficient regenerative fume incinerator.

By spacing the regenerator conduit openings by a circumferential distance at least as great as the circumferential width of the regenerator conduit openings and by making the purge delivery opening of the rotor as wide circumferentially as the circumferential width of the regenerator conduit opening, cross flow from the feed subchamber to the exit subchamber is prevented. The beforementioned cross flow is the undesirable flow of feed gas around the outer edge of the rotor into a regenerator bed conduit outside of the inner surface of the valve housing and into the exit subchamber.

This cross flow can occur only during movement of the valve rotor: such as when moving the valve rotor from one operating flow control position to another during operation of a fume incinerator. The cross flow is prevented by making the peripherial purge zone (the purge gas delivery opening) of the rotor at the middle section of the valve housing at least as wide as the circumferential width of the regenerator bed ports. Cross flow can be substantially eliminated by making the purge gas zone of the rotor at least 60% as wide as the circumferential width of the regenerator bed ports and by spacing the regenerator bed ports circumferentially from one another a distance equal to at least 60% of the circumferential width of the regenerator bed ports.

Although the regenerator bed conduits 21–25 are shown as circular tubes, an oval, square or rectangular shape is often advantageous. With round conduits and five beds, the circumference of the rotor will be about two times five, or ten, times the conduit diameter in order to provide the proper spacing between conduits. For example, with regenerator bed conduits of 4 feet diameter, the rotor circumference will be about 40 feet and the rotor diameter will be 40 divided by pi or 12.7 feet. However if the regenerator bed conduits are designed with a rectangular cross section, an approximate equal flow section area is obtained with a rectangular conduit having a 2 feet by 8 feet section. Thus by placing the 2 feet dimension on the circumference and the 8 feet dimension parallel to the axis of the rotor, instead of a 12.7 feet diameter rotor, the rotor would have a diameter of 6.4 feet (2 times 10 to calculate the circumference and 20 divided by pi to obtain the diameter of 6.4 feet). Thus valve diameter can be balanced against valve length.

Figure 5:
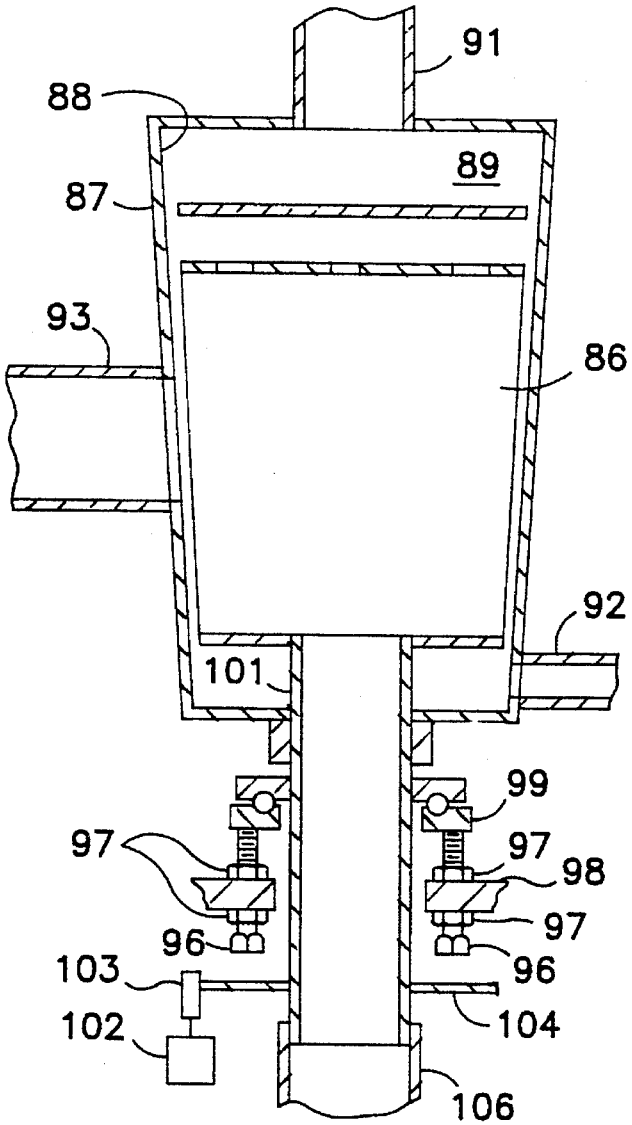
FIG. 5 is a vertical section through a valve of this invention having a tapered rotor, means for adjusting the vertical position of the rotor and drive means for rotating the valve rotor.

Referring to FIG. 5, a modified form of the invention is shown wherein a tapered valve rotor 86 is rotatably mounted in a valve housing 87 which has a complimentary tapered interior surface 88 defining an interior chamber 89. A feed conduit 91 conveys feed gases to the feed gas subchamber of interior chamber 89 and an exit conduit 92 conveys cleaned gas from the exit subchamber of the interior chamber 89. Only one regenerator bed conduit 93 is shown connected to the middle zone of the valve chamber 89, however it should be understood that 3, 5, 7 or more regenerator bed conduits may be so connected about the circumference of the valve housing middle zone. It is advantageous to have the rotor 86 and valve housing 87 both taper at the same angle such as 1 degree to 10 degrees. Moving the rotor down in the valve body will decrease the clearances between the rotor and the housing to compensate for wear. Conversely, moving the rotor out of the valve body could compensate for rubbing or distortion of the rotor. When it is required to bum deposited organic material out of a bed, that bed is heated by out flowing exit gas until the colder end is perhaps 1000 deg. F. This can cause uneven heating of the rotor and temporary warpage. When this step is planned, the tapered rotor can temporarily be moved upward to allow for expected warpage. Binding of the rotor is eliminated at the expense of a momentary increase in clearances between the rotor and the valve body. The vertical position of the rotor can be adjusted by turning support bolts 96 after first loosing lock nuts 97 securing the bolts to a support 98. The upper ends of the support bolts 96 are in vertical thrust transmitting engagement with the bottom raceway of thrust bearing 99. The upper race way of the bearing 99 is secured to the hollow rotor shaft 101. The rotor 86 may be rotated between it various flow control positions by an electric motor 102 having a elongated drive gear 103 meshing with a large diameter gear 104 secured to the rotor shaft 101 . The hollow rotor shaft 101 has a sliding fit with a purge conduit 106.

Figure 6:
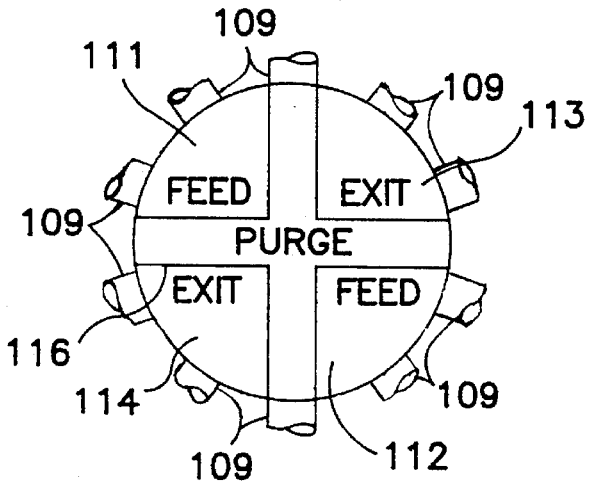
FIG. 6 is a horizontal section through a valve of this invention for a ten bed regenerator incinerator system.

FIG. 6 is a horizontal section through a rotary valve of this invention for a fume incinerator system using ten regenerator beds. In each position of flow control adjustment four regenerator conduits 109 are connected to two feed subchambers 111, 112, four regenerator conduits are connected to two exit subchambers 113, 114 and two regenerator conduits are connected to the purge zone in the interior of the rotor 116.

Figure 7:
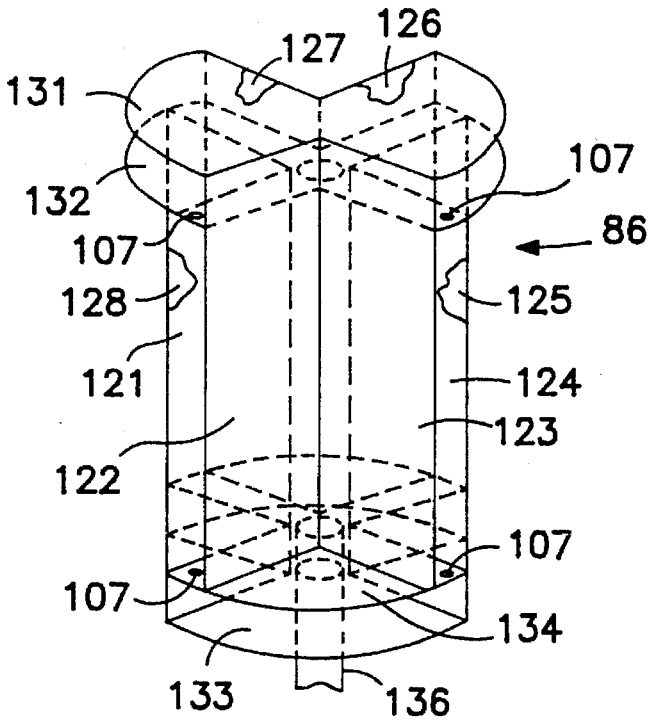
FIG. 7 is a perspective view of a rotor used in the ten bed valve shown in FIG. 6.

FIG. 7 illustrates the rotor 86 used in the valve illustrated in FIG. 6. The valve rotor 86 is fabricated by forming an assembly from eight vertical wall parts 121–128 and four horizontal wall parts 131– 134. A hollow rotor shaft 136 is secured to the lower horizontal wall part 134. The horizontal wall parts 132 and 134 have appropriate holes 107 to permit flow of purge gas to the spaces between the parallel wall parts.

Figure 8:
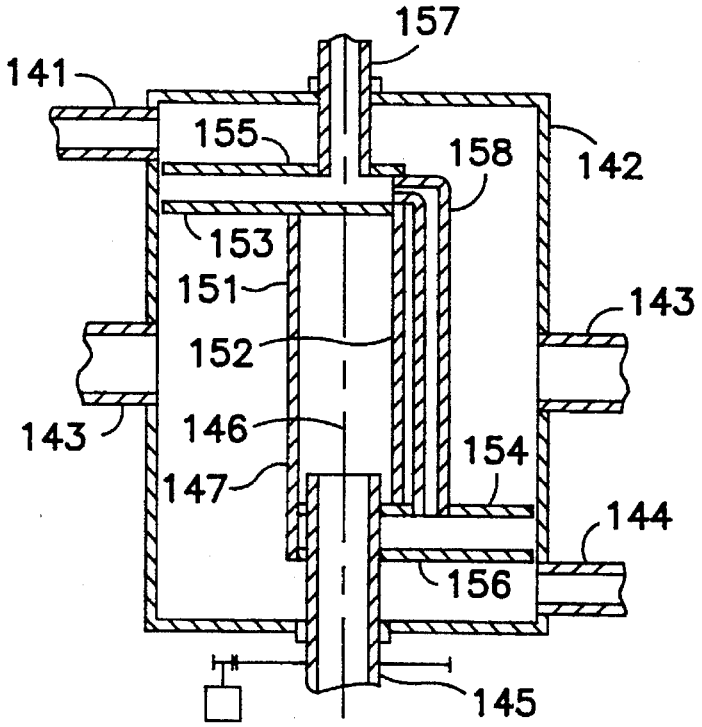
FIG. 8 is a vertical section through an embodiment of the rotary valve of this invention for in which the rotor has major and minor purge plenums.

FIG. 8 is a vertical section through a rotary valve of this invention wherein major and minor purge flows are separate. A feed conduit 141 is connected to the upper section or upper end of the valve housing 142, three or more regenerator bed conduits 143 are connected to the middle portion or section of the valve housing 142, an exit conduit 144 is connected to the lower section of the valve housing 142 and a hollow shaft extends upward through an opening in the bottom end of the valve housing 142, which opening is coaxial with the axis 146 of a valve rotor 147 to which a hollow shaft 145 is secured. Purge gas flows to a major purge gas plenum formed by vertical wall pans 151,152 and horizontal wall parts 153, 154. Two minor plenums formed between parallel wall pans 153 and 155 and between parallel wall parts 154 and 156 are supplied minor purge gas flow by way of a minor purge conduit 157 coaxial with the rotor axis 146 extending through an opening in the upper end of the valve housing 142 and connecting with the upper wall pan 155 at an opening therein. Minor purge gas flowing to the minor plenum between horizontal wall parts 153, 155 also flows to the minor plenum between horizontal wall pans 154, 156 by way of an interconnecting conduit 158. If desired the minor purge conduit 157 can be connected to a blower which delivers withdrawn purge gas to the feed conduit 141. It will be noted that the hollow rotor shaft 145 extends upward through aligned openings in the horizontal wall pans 154, 156 to which the hollow shaft 145 is secured as by welding. The gas for the primary purge zone between wall parts 151,152 need not be the same gas used for the minor purge zone between wall parts 153, 155 and the minor purge zone between horizontal wall pans 154, 156. In fact the major purge zone can be at a pressure higher than the feed gas or at pressure lower than the exit gas. Likewise the minor purge gas can also be at either of these pressures. If either purge is at less than the exit gas pressure, then that purge gas is flowing out of the rotary valve, and can be subsequently purified such as by pumping the purge gas into the feed stream.

Figure 9:
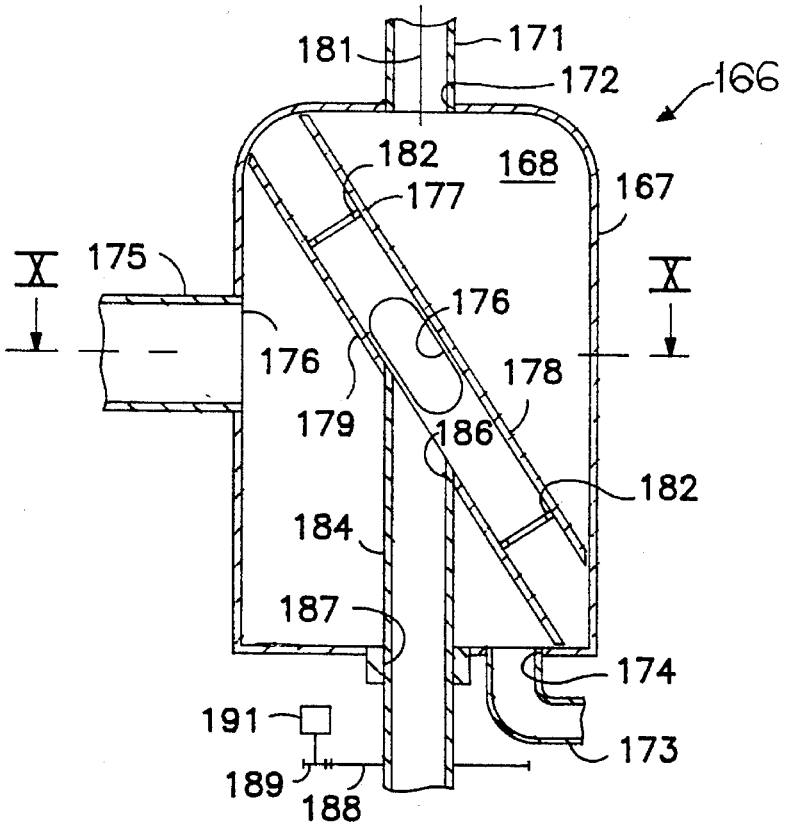
FIG. 9 is a vertical section taken along the line IX—IX in FIG. 10 showing an additional embodiment of this invention and FIG. 10 is a horizontal section taken along the line X—X in FIG. 9.
Figure 10:
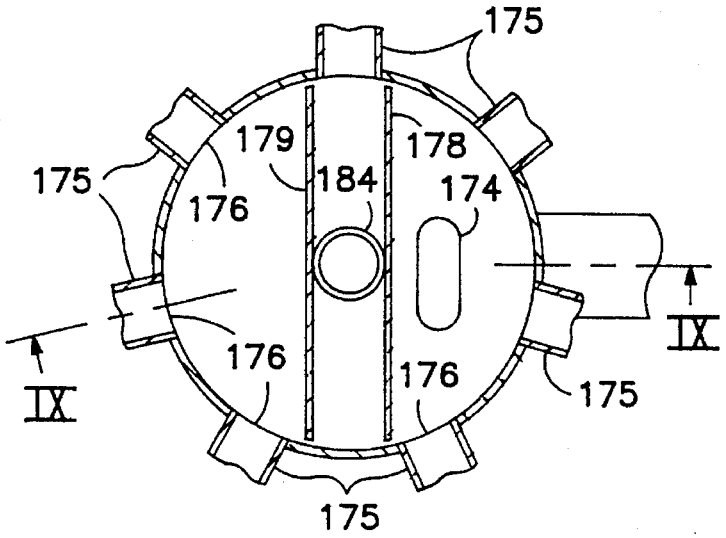

FIGS. 9 and 10 illustrate another embodiment of this invention. A rotary valve 166 includes a cylindrically shaped valve housing 167 having an interior chamber 168 defined by an interior surface which is a surface of revolution. A feed conduit 171 is connected to a feed port 172 in the upper section of the valve housing 167, an exit conduit 173 is connected to an exit port 174 in the lower section of the valve housing 167 and seven regenerator bed conduits 175 are connected to an equal number of regenerator bed ports 176 spaced circumferentially at equal intervals around the middle section of said valve housing 167. A valve rotor 177 is rotatably mounted inside said valve housing 167 and includes a pair of parallel walls 178, 179 extending obliquelly to the rotor axis 181 from the interior surface at the upper section of the valve housing 167 at one side of the rotor axis 181 to the interior surface at the lower section of the valve housing 167 at the other side of the rotor axis 181. The walls 178, 179 are held in spaced relation to one another by spacer struts 182 which are shown to have openings to allow free flow of purge gas. The walls 178, 179 are spaced apart a sufficient distance so that the space therebetween is registrable with any one of the identical regenerator bed ports 176 which, as illustrated, may be oblong and obliquely formed. The space between the walls 178, 179 of the valve rotor constitute a purge zone and a sealing plenum as well as serving as a passageway for the purge gas entering the purge zone of the rotor by way of a purge conduit or tube 184 connected to the wall 179 in registration with an opening 186 therein. The purge conduit 184 extends through an opening 187 aligned with the axis 181 and, as shown, also serves as a rotor shaft by virtue of its having a large gear 188 which is driven by a small drive gear 189 secured to a shaft of a driving motor 191.

The hereinbefore described rotary valve replaces a multitude of valves heretofore required to operate a regenerative fume incinerator. The design of the rotor and housing provides sealing plenums preventing passage of contaminated feed gas from the feed side of the valve rotor to the clean gas on the exit side of the valve rotor.

What is claimed is:

1. A rotary valve for a regenerative fume incinerator apparatus having at least three regenerators, comprising:

a valve housing having an upper section, a lower section, a middle section and an interior chamber with an interior surface defined by rotation of a line about a vertical axis, a feed port in one of said upper and lower sections of said valve housing, an exit port in the other of said upper and lower sections of said valve housing, at least three regenerator bed ports in said middle section of said valve housing, said regenerator bed ports being equally spaced circumferentially around said middle section providing a spacing distance between said regenerator bed ports equal to at least 60% of the circumferential width of said regenerator bed ports, a valve rotor rotatably supported in said valve housing and having a pair of spaced walls extending from said interior surface at said upper section at one side of said axis, across said middle section and to said interior surface at said lower section at the diametrically opposite side of said axis, said purge gas delivery opening having a circumferential width equal to at least 60% of the circumferential width of said regenerator ports, said walls of said valve rotor dividing said interior chamber of said valve housing into a feed subchamber at the end of said housing which includes said feed port and an exit subchamber at the opposite end of said housing which includes said exit port, said walls having edges extending 360 degrees around said rotor in adjacent confronting relation to said interior surface of said valve housing to form a sealing plenum operable to substantially prevent feed gases in said feed subchamber from flowing to said exit subchamber, a rotor shaft opening in one of said ends of said valve housing coaxial with said axis, a purge gas inlet opening in said rotor and a hollow rotor shaft disposed on said axis and extending through said rotor shaft opening and nonrotably connecting with said rotor at said purge gas inlet opening, said hollow rotor shaft and the space between said rotor walls being operable to convey purge gas to said sealing plenum formed by said walls and to a regenerator bed port opening registering with said purge gas delivery opening of said rotor.

2. The rotary valve of claim 1 wherein said walls are parallel to one another.

3. The rotary valve of claim 2 wherein said walls are formed of two parallel walls extending oblique to said axis.

4. The rotary valve of claim 3 wherein said interior surface is cylindrical.

5. The rotary valve of claim 4 wherein the upper and lower ends of said interior chamber are flat portions of said interior surface and wherein at least one of said walls of said rotor extends to one of said flat portions.

6. The rotary valve of claim 1 wherein said rotor includes an upper wall and a lower wall, each of said walls including a vertical wall part, an upper horizontal wall part in the shape of a segment and a lower horizontal wall pan in the shape of a segment.

7. The rotary valve of claim 6 wherein said wall pans of said upper wall are parallel to said wall parts of said lower wall.

8. The rotary valve of claim 6 wherein the upper end of said vertical wall part of said lower wall terminates at said upper horizontal wall pan of said lower wall, wherein said upper horizontal wall pan of said lower wall extends between and interconnects said vertical wall pans and wherein said upper horizontal wall pan of said lower wall includes at least one opening in the portion thereof extending between said vertical wall pans.

9. The rotary valve of claim 6 wherein said vertical wall part of said upper wall connects to said lower horizontal wall pans and includes at least one opening in the portion thereof extending between said lower horizontal wall pans.

10. The rotary valve of claim 1 wherein said feed port is in said upper section of said valve housing.

11. The rotary valve of claim 1 wherein said rotor shaft opening is in said lower section of said valve housing.

12. The rotary valve of claim 11 wherein said walls of said purge gas delivery opening has a circumferential width at least as great as the circumferential width of said regenerator bed ports and wherein said regenerator bed ports are spaced apart circumferentially a distance at least as great as the circumferential width of said regenerator bed ports.

13. The rotary valve of claim 1 wherein said valve rotor and said interior surface of said valve housing are tapered and further comprising means operable to adjust the vertical position of said valve rotor relative to said valve housing thereby changing the clearance between said valve rotor and said interior surface.

14. The rotary valve of claim 1 and further comprising means operable to rotate said valve rotor relative to said valve housing.

15. The rotary valve of claim 1 wherein said valve housing includes five regenerator bed ports, wherein said valve rotor is rotatable between five flow control positions and wherein in each of said flow control positions two of said regenerator bed ports are connected to said feed subchamber, two other of said regenerator bed ports are connected to said exit subchamber and the remaining one of said regenerator ports is connected to said purge gas delivery opening.

16. The rotary valve of claim 1 wherein said valve housing includes seven regenerator bed ports, wherein said valve rotor is rotatable between seven flow control positions and wherein in each of said flow control positions three of said regenerator bed ports are connected to said feed subchamber, three other of said regenerator ports are connected to said exit subchamber and the remaining one of said regenerator bed ports is connected to said purge gas delivery opening.

17. The rotary valve for a regenerative fume incinerator apparatus having at least three regenerator beds comprising:

a valve housing having a upper end, a lower end, a middle portion, an interior chamber defined by an interior surface generated by rotating a line about a vertical axis, at least three regenerator bed ports in said middle portion spaced circumferentially around said middle portion at equal intervals, the spacing between said regenerator bed ports being at least as great as 60% of the circumferencial width of said regenerator bed ports, a feed port in one of said upper and lower ends, an exit port in the other of said upper and lower ends and a rotor shaft opening coaxial with said vertical axis, a valve rotor rotatably disposed in said housing for rotation between flow control positions equal in number to the number of regenerator bed ports, said valve rotor dividing said interior chamber into a feed subchamber and an exit subchamber, said valve rotor including a pair of vertically extending wall parts at opposite sides of said vertical axis, said vertical wall parts being spaced from one another a distance at least equal to 60% of the circumferential width of said regenerator ports, a first pair of spaced horizontal wall parts in the shape of segments connected at their chord ends to the upper portion of one of said vertical wall parts, a second pair of spaced horizontal wall parts in the shape of segments connected at their chord ends to the other of said vertical wall parts, the upper end of said other vertical wall part being connected to the lowermost of said first pair of horizontal wall parts and the lower end of said one vertical wall part being connected to the uppermost one of said second pair of horizontal wall parts, said vertical wall parts together with said lowermost one of said first pair of horizontal wall parts and the uppermost one of said second pair of horizontal wall parts forming a major purge zone and the spaces between said first and second pairs of horizontal wall parts brining minor purge zones and a passageway interconnecting said minor purge zones, in each of said flow control positions of said valve rotor, at least one regenerator bed port is in free flow communication with said feed subchamber, at least one other of said regenerator bed ports is in free flow communication with said exit subchamber and at least another of said regenerator bed ports is registered with said major purge zone between said vertical wall parts, a first tube aligned on said vertical axis and extending through said valve housing to said major purge zone and a second tube aligned on said vertical axis and extending through said valve housing to said minor purge zone, said purge zones constituting sealing plenums preventing flow of feed gas from said feed subchamber to said exit subchamber and said major purge zone serving as a passageway for flow of purge gas to the regenerator bed port in registration with the space between said vertical wall parts.

18. The rotary valve of claim 17 and further comprising means for rotating said valve rotor between said flow control positions.

19. The rotary valve of claim 18 wherein one of said tubes is a rotor shaft and said means for rotating said valve rotor include a driving connection with said one tube.

20. A rotary valve for a regenerative fume incinerator apparatus having at least three regenerator beds, comprising:

a valve housing having an upper section, a lower section, a middle section and an interior chamber with an interior surface defined by rotation of a line about a vertical axis, a feed port in one of said upper and lower sections of said valve housing, an exit port in the other of said upper and lower sections of said valve housing, a regenerator bed port in said middle section of said valve housing for each of said regenerator beds, said regenerator bed ports being equally spaced circumferentially around said middle section providing a spacing distance between said regenerator bed ports at least equal to 60% of the circumferential width of said regenerator bed ports, a valve rotor rotatably supported in said valve housing, said valve rotor having walls extending from said interior surface at said upper section at one side of said axis, across said middle section and to said interior surface at said lower section of said housing at the diametrically opposite side of said axis, said walls at said middle section of said housing defining a purge gas zone including a purge gas outlet opening whose circumferential width is at least as great as 60% of the circumferential width of said regenerator ports, said valve rotor dividing said interior chamber of said valve housing into a feed subchamber at the end of said housing which includes said feed port and an exit subchamber at the opposite end of said housing which includes said exit port, said walls having edges defining sealing plenums extending around said valve rotor in adjacent confronting relation to said interior surface of said valve housing to substantially prevent feed gases in said feed subchamber from flowing to said exit subchamber, a purge gas inlet opening in one of said ends of said valve housing coaxial with said axis and a purge gas tube extending through said purge gas inlet opening and to said valve rotor to supply purge gas to said purge gas zone of said valve rotor, said valve rotor being rotatable between as many flow control position as the number of regenerator bed ports, in any one flow control position at least one of said regenerator bed ports is in registration with the space between said walls so as to receive purge gas, one half of the remaining regenerator bed ports are connected to said feed subchamber and the other half of said remaining regenerator bed ports are connected to said exit subchamber.

21. A rotary valve for controlling gas flow in a regenerative fume incinerator apparatus having at least three regenerator beds, comprising:

a valve housing having an interior chamber defined by a surface of revolution about an axis and including a middle zone and first and second end zones at axially opposite ends, respectively, of said interior chamber, a feed port at said first end zone, an exit port at said second zone, at least three regenerator bed ports spaced circumferentially at equal intervals about said middle zone, the spacing between said regenerator bed ports being at least as great as 60% of the circumferential width of said regenerator bed ports and an annular opening coaxial with said axis at one of said first and second zones, a purge gas conduit coaxial with said axis extending through said annular opening into said interior chamber of said valve housing, a valve rotor rotatably mounted in said valve housing, said valve rotor having walls defining an interior cavity connected in purge gas receiving relation to said purge gas conduit including edges defining at least one purge gas delivery opening in confronting relation to said interior surface at said middle zone and registrable individually with said regenerator bed ports when said valve rotor is rotated, each of said purge gas delivery openings having a circumferential width equal to at least 60% of the circumferential spacing distance between said regenerator bed ports, said walls extending in opposite directions from said purge gas delivery opening to present edges in confronting relation to said interior surface of said housing at opposite sides of said axis to form sealing plenums, said sealing plenums being in free flow communication with said interior cavity, said walls dividing said interior chamber into a feed subchamber in free flow communication with said feed port and an exit subchamber in free flow communication with said exit port, said sealing plenums and purge gas delivery openings substantially preventing leakage of feed gas from said feed subchamber to said exit subchamber and mean rotating said valve rotator to a plurality of flow control positions, in each flow control position at least one of said regenerator bed ports is connected to one of said purge gas delivery openings in said valve rotor, a first half of the other regenerator bed ports are connected to said feed subchamber and a second half of said other regenerator ports are connected to said exit subchamber.

22. A rotary valve for controlling flow of gases in a regenerative fume incineration system having at least three regenerator beds, comprising:

a valve housing having an annular interior chamber, at least three circumferentially spaced regenerator bed ports, a feed port, an exit port and a purge gas supply opening and a valve rotor rotatably mounted in said valve housing having walls dividing said chamber into a feed subchamber to which said feed port is always connected and an exit subchamber to which said exit port is always connected, said valve rotor walls defining a purge zone always connected to said purge gas supply opening and including a purge gas delivery opening registrable one at a time with said regenerator bed ports, said valve rotor being rotatable to as many flow control positions as number of regenerator bed ports, in each of said flow control positions at least one of said regenerator bed ports is connected to said feed subchamber, at least one other of said regenerator bed ports is connected to said exit subchamber and at least another one of said regenerator bed ports is connected to said purge gas delivery opening, by sequentially rotating said valve rotor to said flow control positions, said regenerator bed ports each in turn is sequentially connected to said feed subchamber, said purge gas delivery opening and said exit subchamber.

* * * * *

UNITED STATES PATENT AND TRADEMARK OFFICE

CERTIFICATE OF CORRECTION

PATENT NO. : 5,503,551

DATED : April 2, 1996

INVENTOR(S) : Reagan Houston

It is certified that error appears in the above-identified patent and that said Letters Patent is hereby corrected as shown below:

In line 5 of the Abstract, change "or" to --- for ---;

Col. 1, line 17, change "tiptoe" to --- fume ---;

Col. 1, line 35, change "live" to --- five ---;

Col. 1, line 66, change "pan" to --- part ---;

Col. 2, line 42, change "flame" to --- fume ---;

Col. 2, line 58, change "3,1" to --- 34 ---;

Col. 3, in each of lines 52 and 54, change "pan" to --- part ---;

Col. 5, line 49, change "bum" to --- burn ---;

Col. 6, in each of lines 28, 30, 38, 43 and 47, change "pans" to ---parts ---;

Col. 6, line 34, change "pan" to --- part ---;

Col. 8, in each of lines 20, 27, 28, and 30, change "pan" to --- part ---;

Col. 8, in each of lines 22, 29, 32, 35 and 36, change "pans" to --- parts--;

Col. 9, line 52, change "brining" to --- forming ---;

Signed and Sealed this

Second Day of July, 1996

*Attest:*

BRUCE LEHMAN

*Attesting Officer*

*Commissioner of Patents and Trademarks*